US008308012B2

(12) United States Patent
Xin

(10) Patent No.: US 8,308,012 B2
(45) Date of Patent: Nov. 13, 2012

(54) FASTENING CLIP AND PACKAGE USING THE SAME

(75) Inventor: Shuang-Ming Xin, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 1081 days.

(21) Appl. No.: 12/211,817

(22) Filed: Sep. 17, 2008

(65) Prior Publication Data

US 2009/0211068 A1 Aug. 27, 2009

(30) Foreign Application Priority Data

Feb. 22, 2008 (CN) ..... 2008 1 0300389

(51) Int. Cl.

| | |
|---|---|
| ***B65D 6/00*** | (2006.01) |
| ***B65D 8/14*** | (2006.01) |
| ***B65D 53/00*** | (2006.01) |
| ***B65D 45/16*** | (2006.01) |
| ***B65D 8/04*** | (2006.01) |
| ***B65D 8/18*** | (2006.01) |
| ***B65D 90/02*** | (2006.01) |
| ***B65D 5/20*** | (2006.01) |
| ***B65D 39/00*** | (2006.01) |
| ***B65D 39/12*** | (2006.01) |
| ***A41F 1/00*** | (2006.01) |
| ***A44B 1/04*** | (2006.01) |
| ***A44B 1/18*** | (2006.01) |
| ***A44B 11/25*** | (2006.01) |
| ***A44B 17/00*** | (2006.01) |
| ***B42F 1/00*** | (2006.01) |
| ***B26D 5/42*** | (2006.01) |

(52) U.S. Cl. ..... 220/324; 220/4.33; 220/7; 220/233; 220/238; 220/676; 24/458; 229/122.32; 229/198.1; 215/355; 215/358

(58) Field of Classification Search ..... 220/324, 220/834, 233, 238, 254.3, 7, 676; 215/355, 215/358; 24/458; 229/122.32, 198.1
See application file for complete search history.

(56) References Cited

U.S. PATENT DOCUMENTS

| | | | | |
|---|---|---|---|---|
| 4,053,084 | A * | 10/1977 | Anderson | 220/229 |
| 4,524,902 | A * | 6/1985 | Mortimer | 229/117.09 |
| 4,702,388 | A * | 10/1987 | Boyer et al. | 220/305 |

FOREIGN PATENT DOCUMENTS

| | | | |
|---|---|---|---|
| CN | 200967582 | Y | 10/2007 |
| CN | 201023751 | Y | 2/2008 |

* cited by examiner

*Primary Examiner* — Anthony Stashick
*Assistant Examiner* — Andrew T Kirsch
(74) *Attorney, Agent, or Firm* — Altis Law Group, Inc.

(57) ABSTRACT

A fastening clip includes a main body defining a through hole, a flange radially extending from the main body, a first clipping member hinged on the main body, a latching mechanism extending from the clipping member and including a first latching portion, and a second clipping member hinged on the main body and including a second latching portion. The clip has a first position, in which the first and second clipping members can extend out of the main body, and a second position, in which the first and second clipping members are received in the main body.

20 Claims, 10 Drawing Sheets

9

FASTENING CLIP AND PACKAGE USING THE SAME

BACKGROUND

1. Field of the Invention

The disclosure relates to packaging, and more particularly to a fastening clip and package using the clip.

2. Description of Related Art

Referring to FIG. 1, a conventional method for receiving a product 1 in a conventional package 2 is shown. However, it can be inconvenient to move the product into or out of the package 2 if the volume or weight of the product is significantly high.

DETAILED DESCRIPTION

Figure 1:
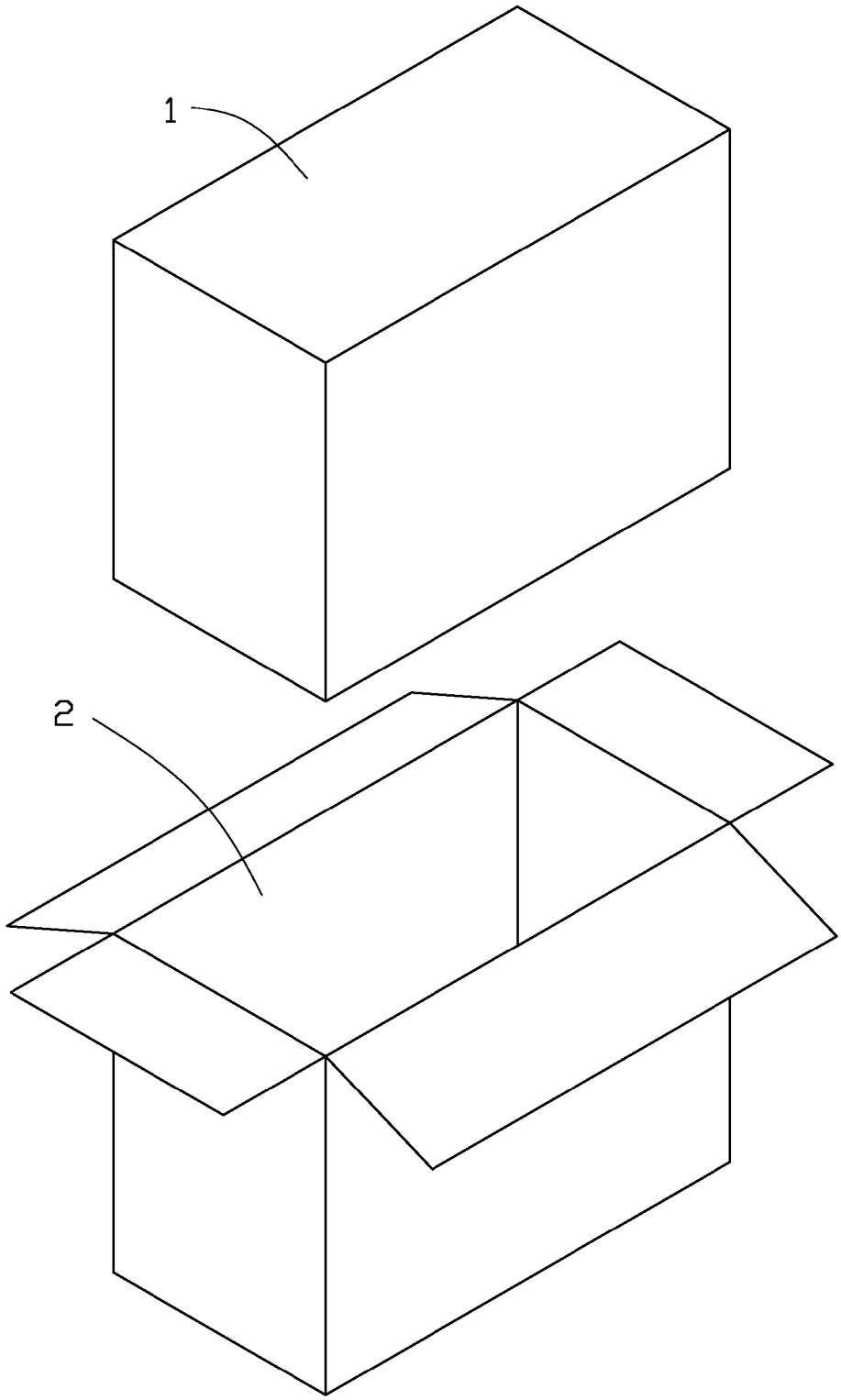
FIG. 1 (RELATED ART)
FIG. 1 is an isometric view of a conventional package and product.
Figure 2:
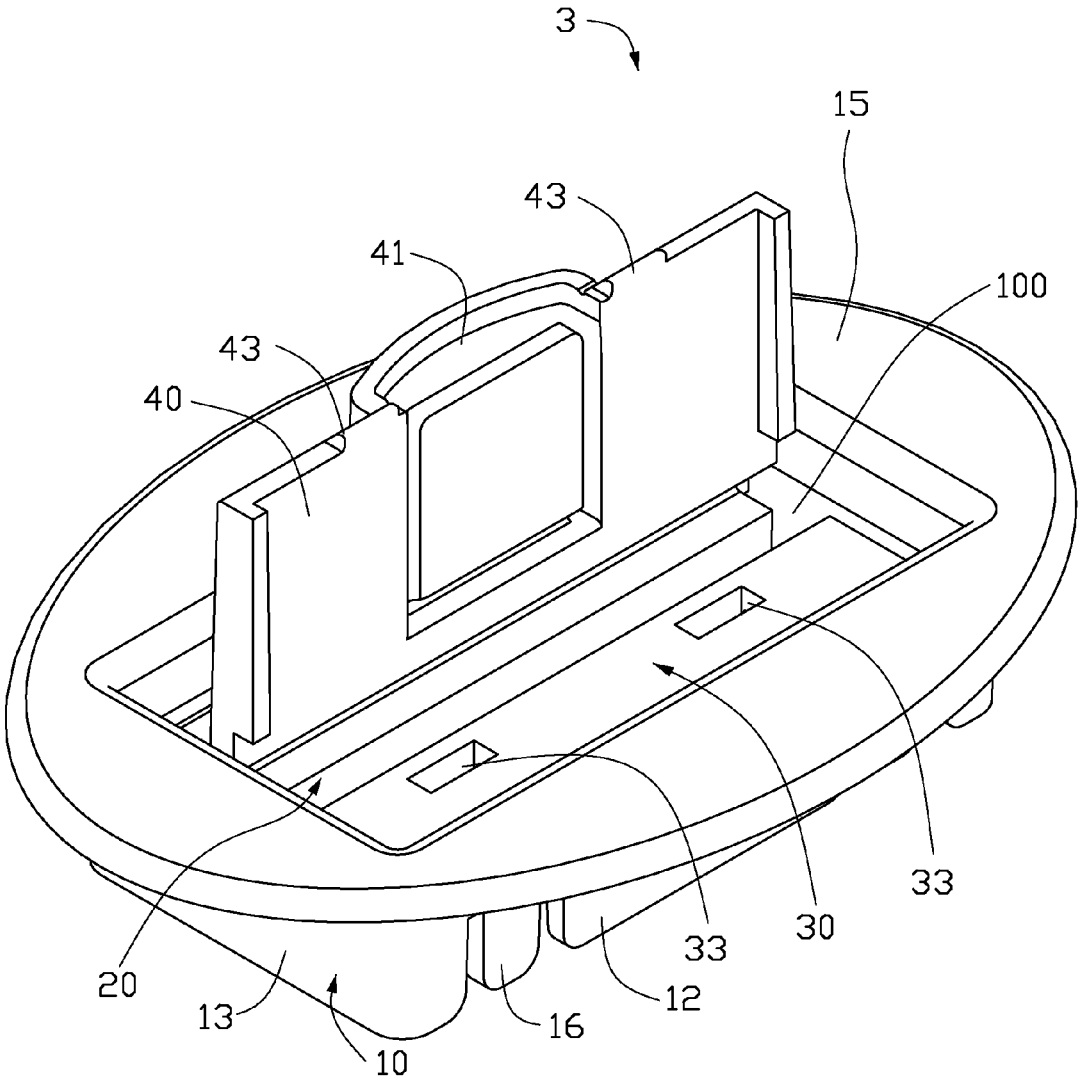
FIG. 2 is an isometric view of a fastening clip in accordance with an embodiment of the disclosure.
Figure 3:
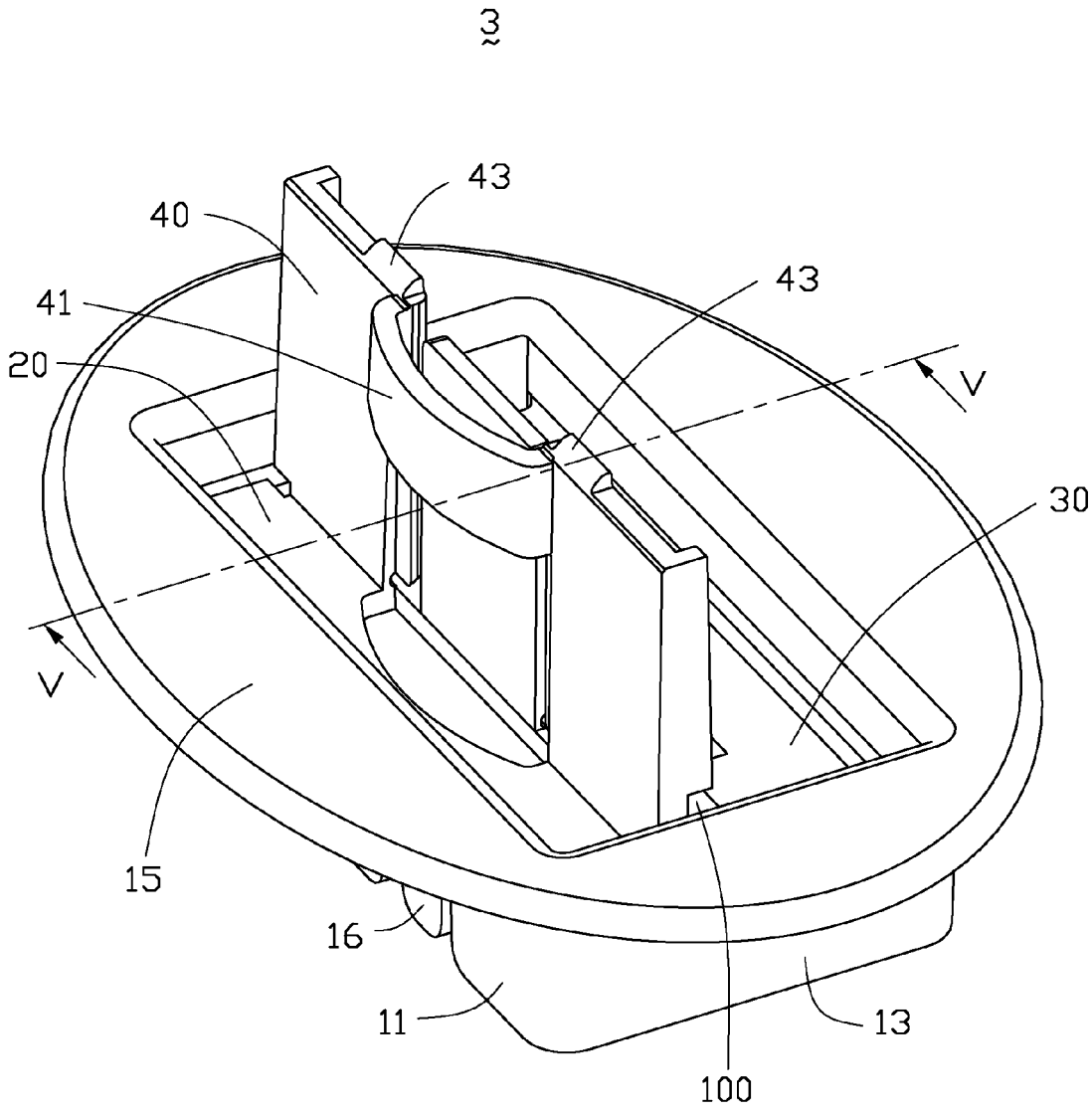
FIG. 3 is similar to FIG. 2, but viewed from another perspective.
Figure 4:
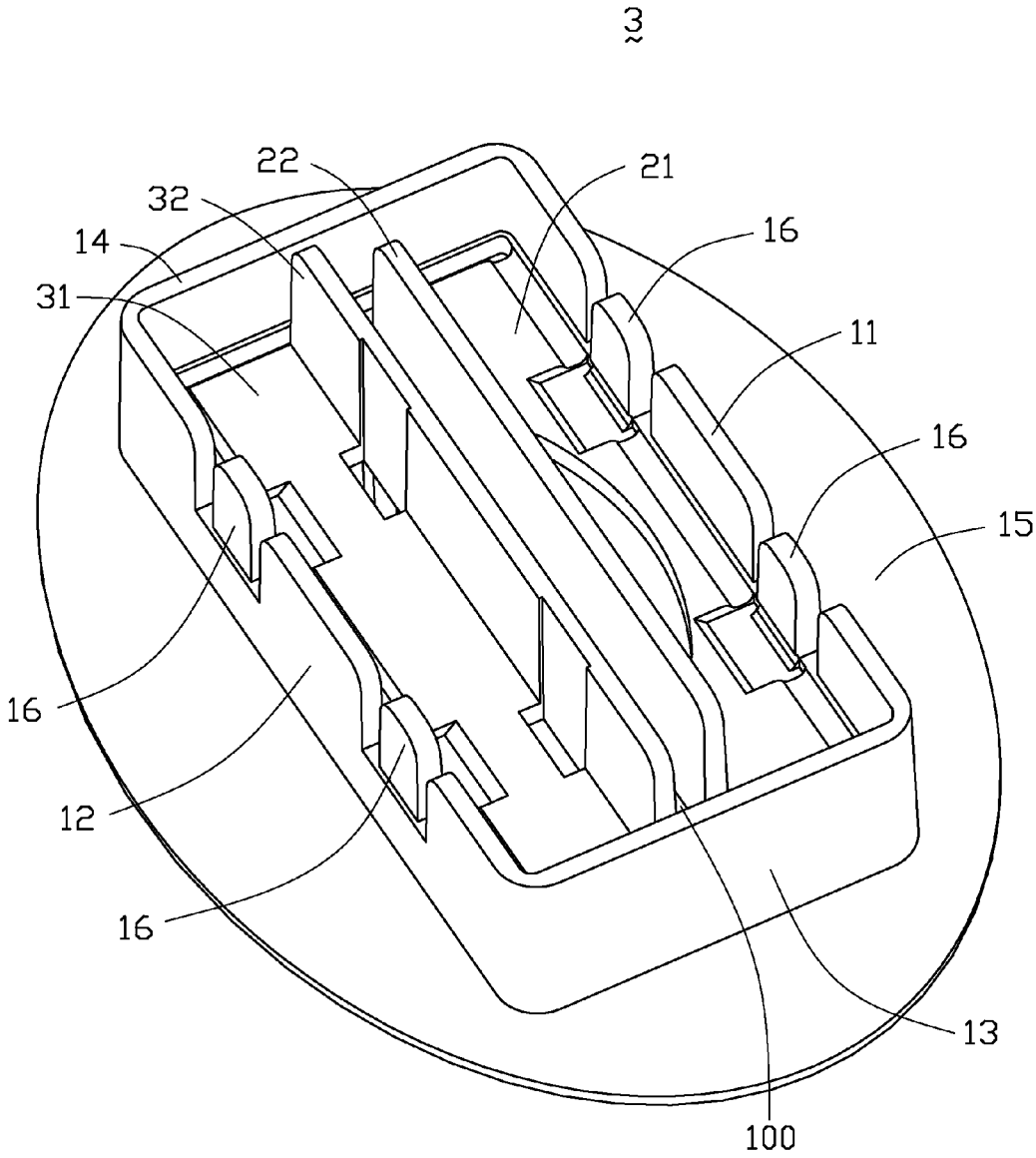
FIG. 4 is an inverted view of FIG. 3.

Referring to FIGS. 2 to 4, a fastening clip 3 is provided in accordance with an embodiment of the disclosure. While clip 3 is plastic formed by injection molding, those having ordinary skill in the art will readily recognize that a variety of materials can be utilized while remaining within the spirit and scope of the disclosure. The clip 3 includes a main body 10, a first clipping member 20, a second clipping member 30, and a latching mechanism 40.

The main body 10 includes a vertical first wall 11, a second wall 12 opposite and parallel to the first wall 11, a vertical third wall 13 connected between corresponding ends of the first and second walls 11, 12, and a vertical fourth wall 12 opposite to the third wall 11 and connected between corresponding ends of the first and second walls 11, 12. The main body 10 defines an opening 100 surrounded by the four walls 11, 12, 13, 14. The opening 100 is configured for receiving the first clipping member 20, the second clipping member 30, and the latching mechanism 40. A flange 15 extends perpendicularly from the top ends of the walls 11, 12, 13, 14. An edge of the flange 15 is located along an ellipse. Each of the first and second walls 11, 12 defines two breaches, with each receiving an elastic piece 16 that extends from the main body 10.

Figure 5:
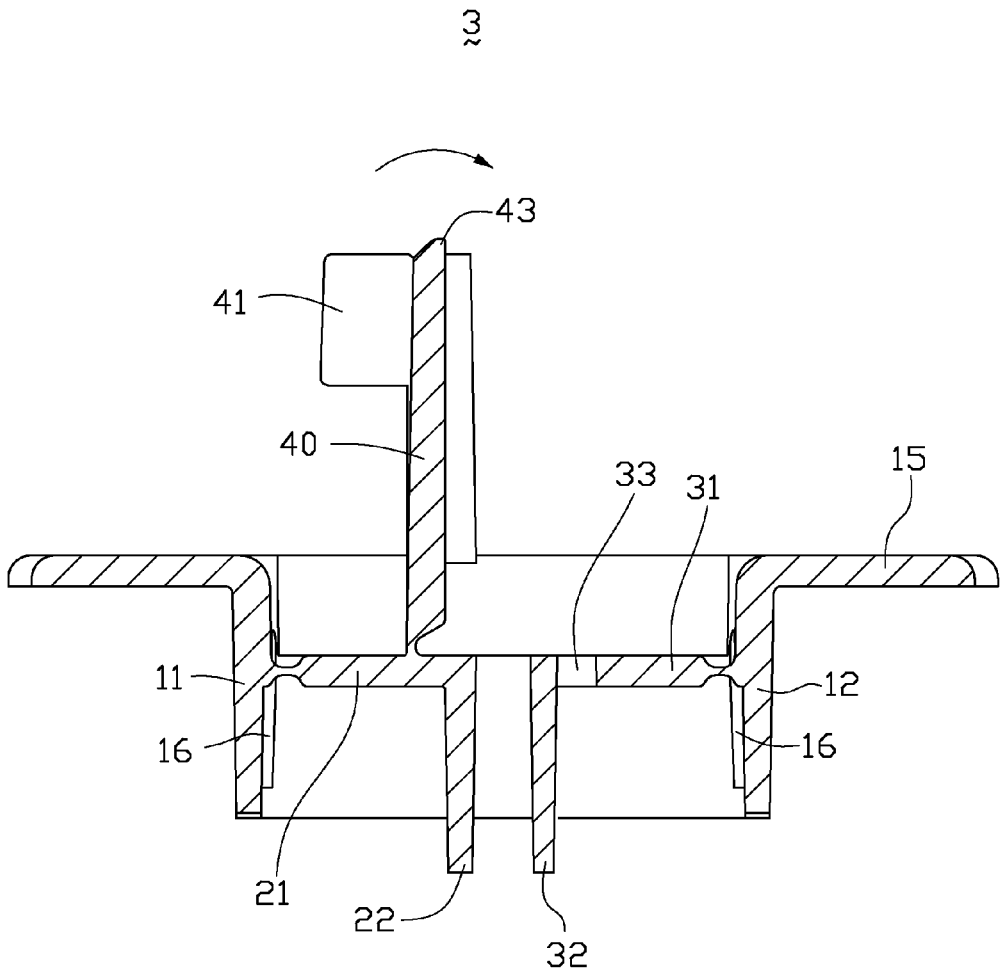
FIG. 5 is a cross-section taken along a line V-V of FIG. 3.

FIG. 5 shows a released clip 3 in a released state. The first clipping member 20 includes a first leg 21 perpendicularly hinged on the first wall 11 of the main body 10, and a first foot 22 extending perpendicularly down from a distal end of the first leg 21.

The second clipping member 30 includes a second leg 31 perpendicularly hinged on the second wall 12 of the main body 10, and a second foot 32 extending perpendicularly down from a distal end of the second leg 31. Two latching holes 33 are defined in the second leg 31. The second leg 21 is aligned with the first leg 31.

The latching mechanism 40 includes a board extending perpendicularly up from the first leg 21 of the first clipping member 20, two latching tongues 43 extending from the free end of the board, and a release tab 41 attached to a side of the board.

Figure 6:
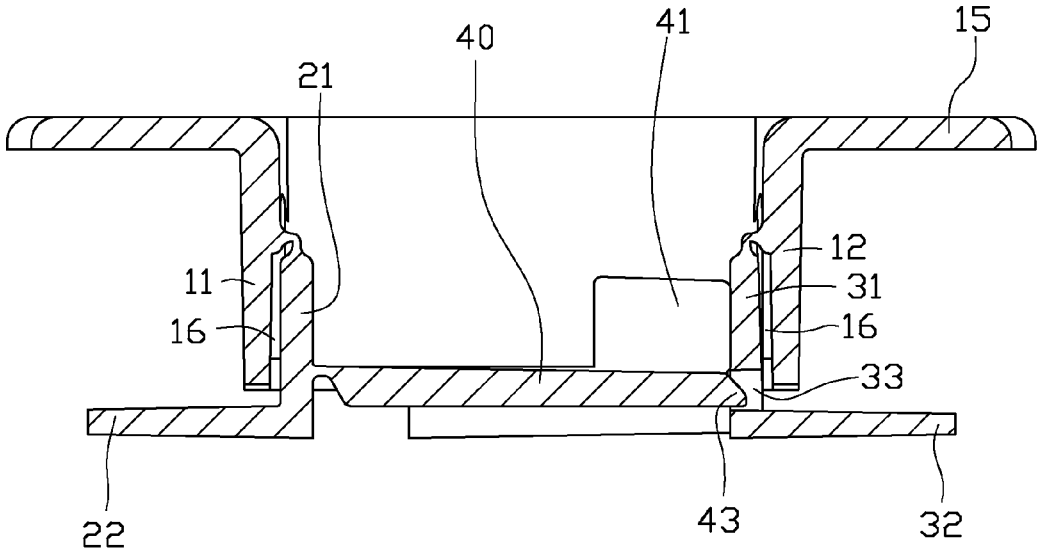
FIG. 6 is similar to FIG. 5, but shows the fastening clip clipping.
Figure 7:
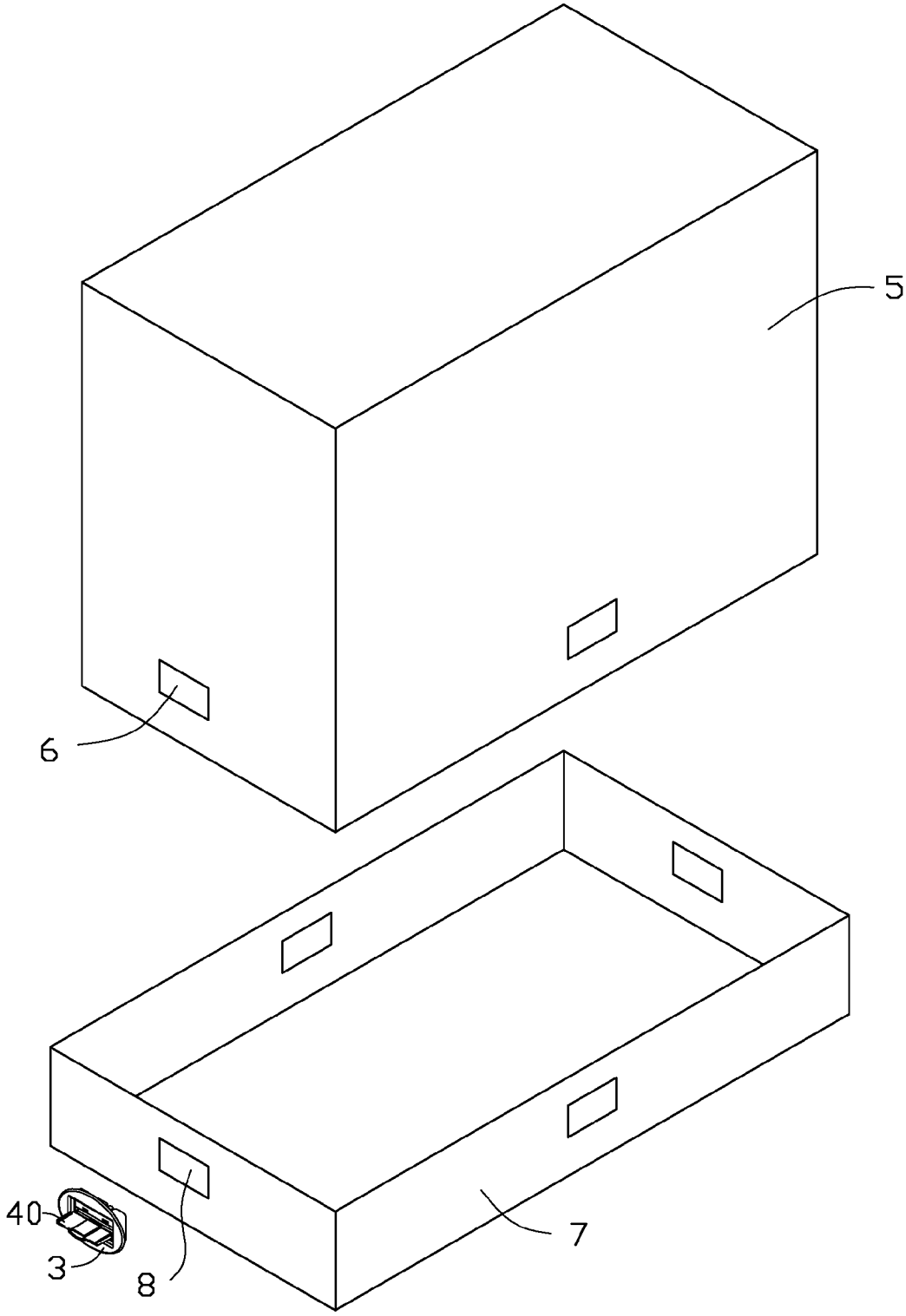
FIG. 7 is an exploded, isometric view of a package in accordance with an embodiment of the disclosure, the package using the fastening clip of FIG. 2.

Referring also to FIG. 7, clip 3, in accordance with the disclosure, holds multiple bodies of a package together. The package includes a lower body 5 for supporting a product to be packaged, and an upper body 5 for covering the product. The upper body 5 is rectangular and has no bottom plate, while the lower body 7 is rectangular and has no top plate. In order to clip the two bodies 5, 7 together, through holes 6, 8, approximately the size of the perimeter of the four walls 11, 12, 13 14 of the main body 10 are defined in the side plates of the lower and upper bodies 5, 7. One of the bodies 5, 7 is received in the other. The walls 11, 12, 13 14 are then placed into the through holes 6, 8. Referring also to FIG. 6, the latching mechanism 40 engages clip 3 to couple the two bodies 5, 7 of the package.

When the clip 3 is engaged, the first leg 21 and the second leg 31 hingedly rotate approximately 90°, and the first foot 22 and the second foot 32 extend from the main body 10 in a perpendicular fashion. Since the span of the extended feet 22, 32 now exceeds that of the through holes 6, 8 in the lower and upper bodies 5,7, the feet 22, 32 and the flange 15 sandwich the corresponding side plates of the lower and upper bodies 5, 7, thereby securely attaching the package.

Referring to FIGS. 5 and 6, when the clip 3 engages, the latching mechanism 40 rotates the first leg 21, wherein the latching tongues 43 touch, then impel the second leg 31. The first and second legs 21, 31 impel the corresponding elastic pieces 16. The elastic pieces 16 are deformed and put pressure on the latching tongues 43 via the second leg 31. The latching tongues 43 extend into the latching holes 33. The elastic pieces 16 restore to cause the clip 3 to snap shut with a distinctive sound. The sound is an indicator that the clip 3 has been secured at the clipping state. The engagement between the latching tongues 43 and the latching holes 33 maintains the clipping state of the clip 3.

Clip 3 remains closed until release tab 41 is withdrawn. This causes the latching tongues 43 to disengage from the latching holes 33, thereby allowing latch mechanism 40 to slide back.

During packaging, the product is initially put into the lower body 5 and then covered by the upper body 7. Subsequently, the clips 3 couple bodies 5 and 7 together. Thus, the product is securely received in the package. The use of clips 3 in the packaging process allows convenient placement and extraction of the product. Moreover, the clips 3 are reusable.

Figure 8:
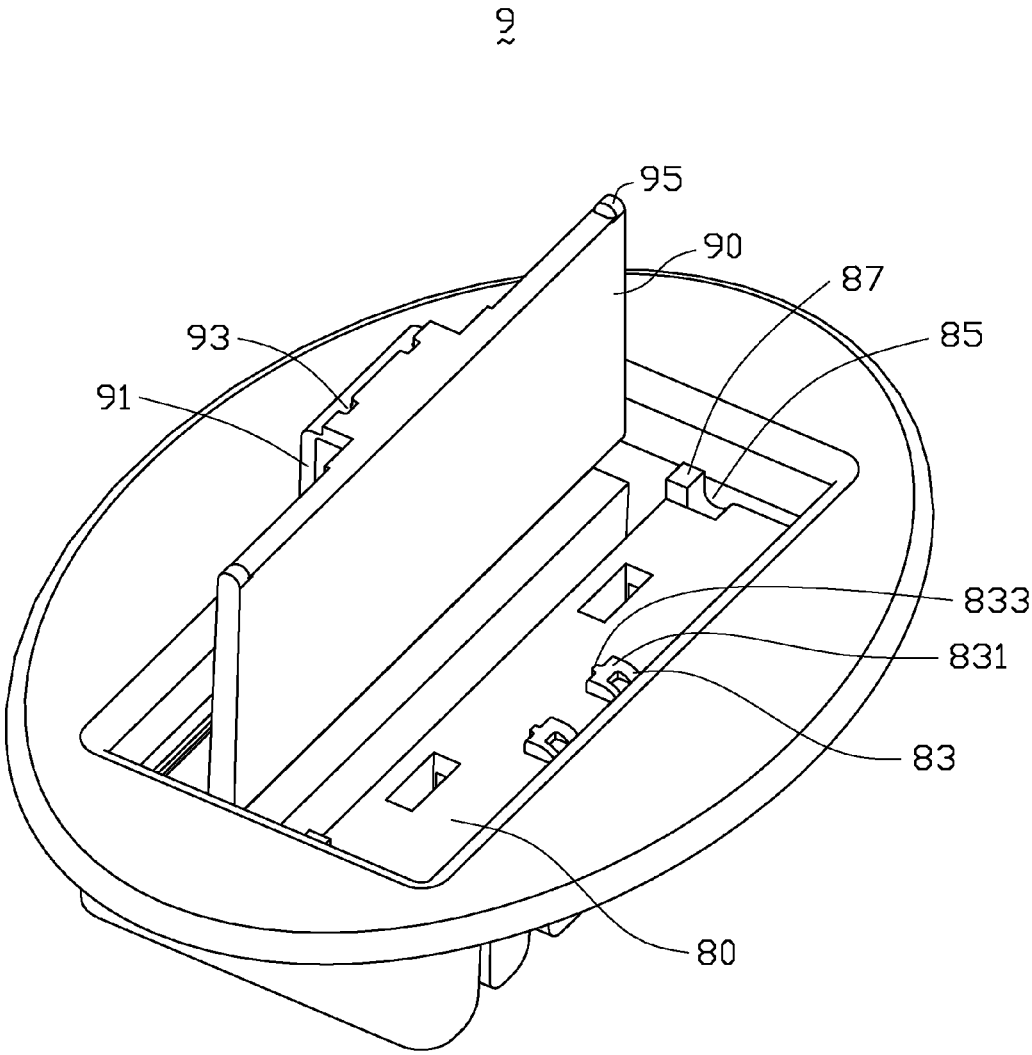
FIG. 8 is an isometric view of a fastening clip in accordance with another embodiment of the disclosure.
Figure 9:
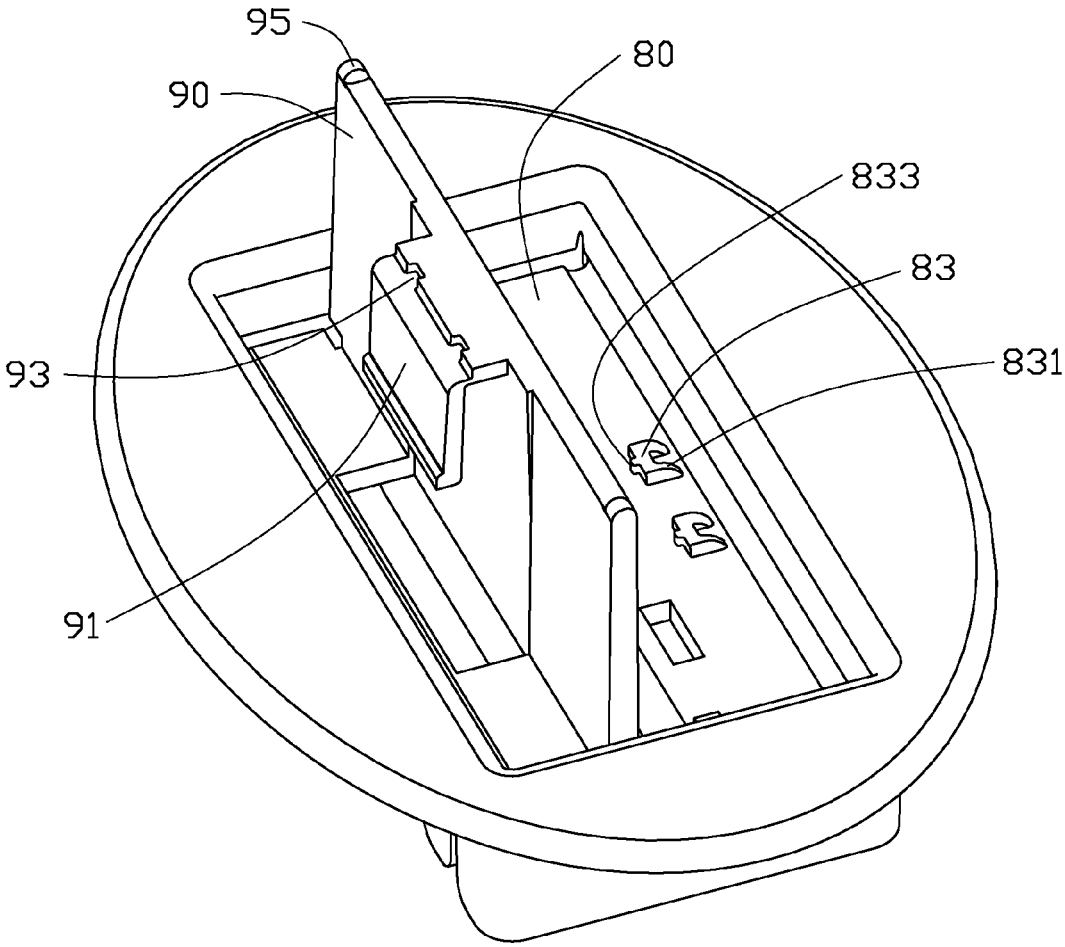
FIG. 9 is similar to FIG. 8, but viewed from another perspective.
Figure 10:
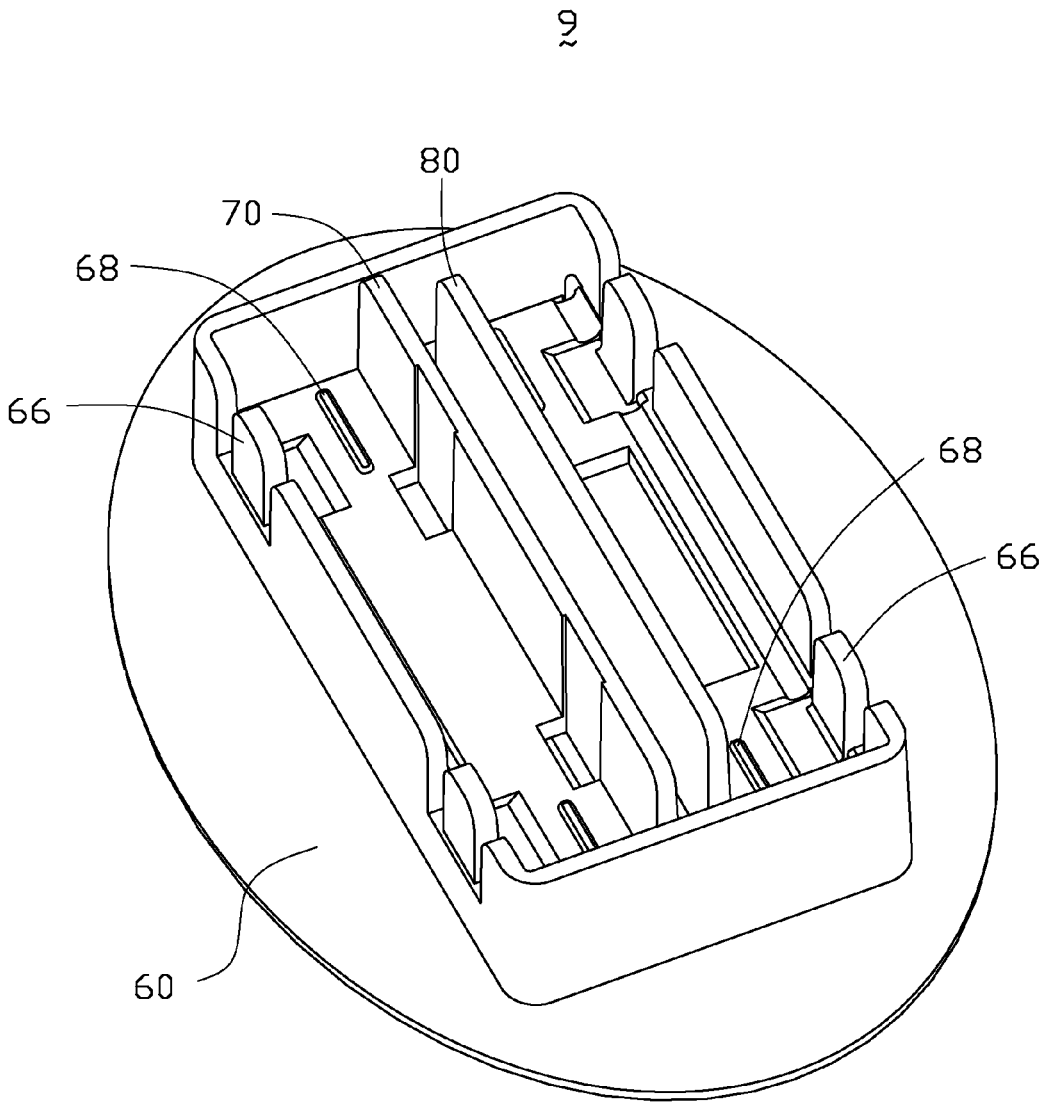
FIG. 10 is an inverted view of FIG. 9.

Referring to FIGS. 8, 9 and 10, a fastening clip 9 is provided in accordance with a second embodiment of the disclosure, differing from the first as follows.

Latching mechanism 90 of the clip 9 defines two grooves 93 in a free end of the board, and two blocks 83 extend from the second leg 80 of the clip 9, each including a curved guide surface 831 and a latching protrusion 833. The free end of the board of the latching mechanism 90 engages the guide surfaces 831 until the latching protrusions 833 are seated in the corresponding grooves 93.

Further, two protrusions 95 extend from the free end of the latching mechanism 90 of the clip 9, with two grooves 85 correspondingly defined in the second leg 80. The protrusions 95 can engage the grooves 85 to further reinforce the fastening.

Also, two bars 87 extending from the second leg 80 of the clip 9 can fix the latching mechanism 90 thereon to prevent excessive rotation of the latching mechanism 90.

A plurality of bar-shaped protrusions 68 also extends from the first and second legs 70, 80 corresponding to the elastic pieces 66, enabling elastic pieces 66 to further deform when engaging with the legs 70, 80.

It is to be understood, however, that even though numerous characteristics and advantages of the disclosure have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fastening clip comprising:

a main body comprising opposite first and second walls, and a flange extending from the first and second walls;

a first clipping member; wherein the first clipping member comprises a first leg hinged on the first wall, and a first foot extending from the first leg;

a latching mechanism extending from the first leg and comprising a first latching portion; and a second clipping member; wherein the second clipping member comprises a second leg hinged on the second wall, and a second foot extending from the second leg; the second leg comprising a second latching portion;

wherein when the latching mechanism together with the first clipping member is rotated, the latching mechanism rotates the second clipping member, until the first latching portion engages the second latching portion and the first and second feet extend out of the main body; and wherein a protrusion extends from a side of the first leg facing the first wall, an elastic piece extends from the first wall to resist against the protrusion of the first clipping member, thereby biasing the first clipping member to the second clipping member and preventing the first latching portion from disengaging from the second latching portion.

2. The fastening clip as claimed in claim 1, wherein the first latching portion comprises a latching tongue, the second latching portion comprises a latching hole, and the latching tongue is engagable with the latching hole.

3. The fastening clip as claimed in claim 1, wherein the first latching portion comprises a groove; the second latching portion comprises a block, the block comprises a guide surface and a latching protrusion; a free end of the latching mechanism is engagable with the guide surface, and the latching protrusion is engagable with the groove.

4. The fastening clip as claimed in claim 1, wherein another elastic piece extends from the second wall, configured to bias the second clipping member toward the first clipping member.

5. The fastening clip as claimed in claim 4, wherein another protrusion extends from a side of the second leg facing the second wall to press against the elastic piece of the second wall.

6. The fastening clip as claimed in claim 1, wherein the latching mechanism further comprises a release tab.

7. The fastening clip as claimed in claim 1, wherein the fastening clip is plastic.

8. A package comprising:

two bodies capable of collectively constituting a container box, each comprising a sideboard, each of which defines a hole for receiving a clip, wherein the clip comprises:

a main body; wherein the main body comprises opposite first and second walls, and a flange extending from the first and second walls;

a first clipping member; wherein the first clipping member comprises a first leg hinged on the first wall, and a first foot extending from the first leg;

a latching mechanism extending from the first leg and comprising a first latching portion; and a second clipping member; wherein the second clipping member comprises a second leg hinged on the second wall, and a second foot extending from the second leg; the second leg comprising a second latching portion;

wherein the clip can alternate between a first position in which the first and second feet extend out of the main body with the sideboards sandwiched between the flange and the first and second feet, and a second position in which the first and second feet are received in the main body with the clip disengaged from the sideboards; and wherein an elastic piece extends from the first wall, to engage with the first clipping member, thereby biasing the first clipping member towards the second clipping member in response to the clip being at the first position, and to separate from the first clipping member in response to the clip being at the second position.

9. The package as claimed in claim 8, wherein when the clip moves from the second position to the first position, the latching mechanism is rotatable together with the first clipping member, and the latching mechanism rotates the second clipping member until the first latching portion engages the second latching portion.

10. The package as claimed in claim 9, wherein the first latching portion comprises a latching tongue and the second latching portion comprises a latching hole, wherein the latching tongue is engagable with the latching hole.

11. The package as claimed in claim 9, wherein the first latching portion comprises a groove and the second latching portion comprises a block, the block comprising a guide surface and a latching protrusion, with a free end of the latching mechanism engagable with the guide surface and the latching protrusion engagable with the groove.

12. The package as claimed in claim 9, wherein another elastic piece extends from the second wall to engage with the second clipping member, thereby biasing the second clipping member towards the first clipping members in response to the clip being at the first position, and to separate from the second clipping member in response to the clip being at the second position.

13. The package as claimed in claim 12, wherein two protrusions respectively extend from the first and second clipping members to engage with the elastic pieces of the first and second walls in response to the clip being at the first position.

14. The package as claimed in claim 9, wherein the latching mechanism further comprises a release tab.

15. An apparatus comprising a clip, the clip comprising:

a main body defining a through hole;

a flange radially extending from the main body;

a first clipping member hinged on the main body;

a latching mechanism extending from the clipping member and comprising a first latching portion; and a second clipping member hinged on the main body and comprising a second latching portion;

wherein the clip, in a first position comprises the first and second clipping members out of the through hole, and in a second position, comprises the first and second clipping members received in the through hole;

wherein an elastic piece extends from the first wall, to engage with the first clipping member, thereby biasing the first clipping member towards the second clipping member in response to the clip being at the first position, and to separate from the first clipping member in response to the clip being at the second position.

16. The apparatus as claimed in claim 15, wherein when the clip moves from the second position to the first position, the latching mechanism rotates together with the first clipping member, and the latching mechanism rotates the second clipping member until the first latching portion engages the second latching portion.

17. The apparatus as claimed in claim 16, wherein the first latching portion comprises a latching tongue, and the second latching portion comprises a latching hole engagable with the latching tongue.

18. The apparatus as claimed in claim 16, wherein the first latching portion comprises a groove, and the second latching portion comprises a block comprising a guide surface and a latching protrusion, and a free end of the latching mechanism is engagable with the guide surface, and the latching protrusion is engagable with the groove.

19. The package as claimed in claim 16, wherein another elastic piece extends from the second wall to engage with the second clipping member, thereby biasing the second clipping member towards the first clipping members in response to the clip being at the first position, and to separate from the second clipping member in response to the clip being at the second position.

20. The package as claimed in claim 19, wherein two protrusions respectively extend from the first and second clipping members to engage with the elastic pieces of the first and second walls in response to the clip being at the first position.

* * * * *